US009087481B2

(12) United States Patent
Park

(10) Patent No.: US 9,087,481 B2
(45) Date of Patent: Jul. 21, 2015

(54) LUMINANCE CORRECTING SYSTEM AND LUMINANCE CORRECTING METHOD FOR ORGANIC LIGHT EMITTING DISPLAY

(75) Inventor: Jung-Kook Park, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 326 days.

(21) Appl. No.: 13/367,275

(22) Filed: Feb. 6, 2012

(65) Prior Publication Data

US 2012/0242680 A1 Sep. 27, 2012

(30) Foreign Application Priority Data

Mar. 23, 2011 (KR) ..... 10-2011-0025889

(51) Int. Cl.
*G09G 3/32* (2006.01)

(52) U.S. Cl.
CPC ..... *G09G 3/3233* (2013.01); *G09G 3/3208* (2013.01); *G09G 2320/0673* (2013.01); *G09G 2360/145* (2013.01)

(58) Field of Classification Search
CPC ..... G09G 2320/043; G09G 2320/0233; G09G 3/3208; G09G 5/02; G09G 2320/0276; G09G 2320/0633; G09G 2320/062
See application file for complete search history.

(56) References Cited

U.S. PATENT DOCUMENTS

| | | | | |
|---|---|---|---|---|
| 2005/0140830 | A1* | 6/2005 | Kim et al. | 348/674 |
| 2007/0052735 | A1* | 3/2007 | Chou | 345/690 |
| 2007/0127837 | A1* | 6/2007 | Ishii | 382/270 |
| 2009/0219306 | A1* | 9/2009 | Oh et al. | 345/690 |
| 2010/0079502 | A1* | 4/2010 | Moroney | 345/690 |
| 2011/0018891 | A1* | 1/2011 | Peng et al. | 345/589 |
| 2011/0109661 | A1* | 5/2011 | Lee | 345/690 |

FOREIGN PATENT DOCUMENTS

KR 10-2009-0093018 A 9/2009

* cited by examiner

*Primary Examiner* — Mark Zimmerman
*Assistant Examiner* — Sarah Le
(74) *Attorney, Agent, or Firm* — Christei, Parker & Hale LLP

(57) ABSTRACT

A luminance correcting system for an organic light emitting display includes an image analyzing unit for analyzing an image on a display unit and for measuring luminance and color coordinates of reference gray level data, a reference offset value setting unit for setting reference offset values of respective color data in the reference gray level data to correspond to an image analysis result obtained by the image analyzing unit, a controller for detecting a difference in reference offset values of at least two color data among the respective color data in the reference gray level data and for comparing the difference with a reference value, and an additional offset value setting unit for setting an additional offset value corresponding to at least one gray level among gray level data excluding the reference gray level data when the difference in the reference offset values is not less than the reference value.

7 Claims, 4 Drawing Sheets

LUMINANCE CORRECTING SYSTEM AND LUMINANCE CORRECTING METHOD FOR ORGANIC LIGHT EMITTING DISPLAY

CROSS-REFERENCE TO RELATED APPLICATION

This application claims priority to and the benefit of Korean Patent Application No. 10-2011-0025889, filed on Mar. 23, 2011, in the Korean Intellectual Property Office, the entire content of which is incorporated herein by reference.

BACKGROUND

1. Field

Embodiments of the present invention relate to a luminance correcting system and method for an organic light emitting display.

2. Description of Related Art

An organic light emitting display is a type of a flat panel display (FPD) in which an organic compound is used as an emission material. The organic light emitting display has high luminance and color purity, is thin and light, may be driven by low power, and is expected to be useful to various display devices, such as a portable display device.

The organic light emitting display generates data signals having voltages in accordance with respective gray levels based on a reference gamma voltage, and displays an image corresponding to the data signals. Due to variations in manufacturing processes, the luminance components of completed products may be different from a target (e.g., intended) luminance.

When the luminance of a completed product does not reach a target value, the product is determined to be defective. Therefore, it is necessary to correct the measured luminance components of FPDs for the completed products to display the target luminance.

When only the luminance of the organic light emitting display is corrected, due to differences in the efficiency of organic material among differently colored pixels (e.g., a red pixel, a green pixel, and a blue pixel), white balance may deteriorate. Therefore, to solve such a problem, color coordinates may be corrected together with luminance.

However, conventionally, correction of the luminance and the color coordinates is performed only on a reference gray level (e.g., a predetermined reference gray level), and an offset value generated during the correction is directly applied to the remaining gray levels. In this case, correction close to the target value is performed on the reference gray level. However, a difference between luminance and color coordinates and the target value increases in the remaining gray levels, in particular, at gray levels further from the reference gray level.

In addition, the efficiency of the emission organic material of each color may vary with different panels. Therefore, the offset values of the respective colors may be different from each other.

However, correction performed without reflecting the difference in the offset values of the respective colors may generate a phenomenon in which specific colors (e.g., reddish, greenish, and/or bluish hues) may be pronounced in the gray levels (e.g., low gray levels) further from the reference gray levels.

SUMMARY

Accordingly, embodiments according to the present invention provide a luminance correcting system and a luminance correcting method for an organic light emitting display capable of preventing color coordinates from being twisted in the respective gray levels and luminance components (e.g., specific colors, such as reddish, greenish, and bluish hues) from being pronounced (e.g., remarkable) in low gray levels by setting a reference offset value to correct the gamma voltage of a reference gray level. This is achieved in one embodiment by detecting a difference in the offset values of the respective colors, and by setting an additional offset value corresponding to at least one gray level among remaining gray levels, excluding (e.g., other than) the reference gray level, when the difference (e.g., a value of the difference) is not less than a reference value, to apply the set offset value to correction of the gamma voltage corresponding to the gray level.

In order to achieve the foregoing and/or other aspects of embodiments according to the present invention, according to one embodiment, there is provided a luminance correcting system for an organic light emitting display including an image analyzing unit for analyzing an image displayed on a display unit of the organic light emitting display and for measuring luminance and color coordinates of reference gray level data, a reference offset value setting unit for setting reference offset values of respective color data in the reference gray level data to correspond to an image analysis result obtained by the image analyzing unit, a controller for detecting a difference in reference offset values of at least two color data among the respective color data in the reference gray level data and for comparing the difference in the reference offset values with a reference value, and an additional offset value setting unit for setting an additional offset value corresponding to at least one gray level among gray level data excluding the reference gray level data when the difference in the reference offset values is not less than the reference value.

The luminance correcting system for an organic light emitting display may also include a gamma voltage correcting unit for correcting a gamma voltage of the reference gray level data to correspond to one of the reference offset values and/or the additional offset value, and for outputting the corrected gamma voltage, and a gamma voltage applying unit for applying the corrected gamma voltage to a data driver of the organic light emitting display.

The reference gray level data may be data of a highest gray level.

The gray level data excluding the reference gray level data may be low gray level data.

The low gray level data might have a value of no more than ⅓ of a value of a highest gray level data.

The at least two color data may be among red, blue, and green data.

An additional offset value corresponding to color data having a largest reference offset value of the at least two color data may have a negative value when the difference of the reference offset values of the at least two color data is not less than the reference value.

According to another embodiment of the present invention, there is provided a luminance correcting method for an organic light emitting display including analyzing an image displayed on a display unit of the organic light emitting display and measuring luminance and color coordinates of reference gray level data, setting reference offset values corresponding to respective color data in the reference gray level data corresponding to an image analysis result, detecting a difference in reference offset values of at least two color data among the respective color data in the reference gray level data and comparing the difference with a reference value, and setting an additional offset value corresponding to at least one gray level among remaining gray level data excluding the reference gray level data when the difference in the reference offset values is not less than the reference value.

The luminance correcting method may also include correcting a gamma voltage of the reference gray level data corresponding to one or more of the reference offset values and/or the additional offset value and outputting the corrected gamma voltage, and applying the corrected gamma voltage to a data driver of the organic light emitting display.

The reference gray level data may be data of a highest gray level.

The remaining gray level data excluding the reference gray level data may include low gray level data.

The low gray level data might have a value of no more than ⅓ of a value of a highest gray level data.

The at least two color data may be among red, blue, and green data.

An additional offset value corresponding to color data having a largest reference offset value of the at least two color data may have a negative value when the difference of the reference offset values of the at least two color data is not less than the reference value.

According to embodiments of the present invention, the reference offset value is set to correct the gamma voltage of the reference gray level, the difference in the reference offset values of the respective colors is detected, and the additional offset value is set with respect to at least one gray level among the remaining gray levels (excluding the reference gray level) when the difference is not less than the reference value so that the set offset value is applied to correcting the gamma voltage corresponding to the gray level. Therefore, it is possible to prevent the color coordinates from being twisted in the respective gray levels, and luminance components, in particular, the specific colors (e.g., reddish, greenish, and bluish colors), from being pronounced in the low gray levels.

BRIEF DESCRIPTION OF THE DRAWINGS

The accompanying drawings, together with the specification, illustrate exemplary embodiments of the present invention, and, together with the description, serve to explain aspects of embodiments according to the present invention.

DETAILED DESCRIPTION

Figure 1:
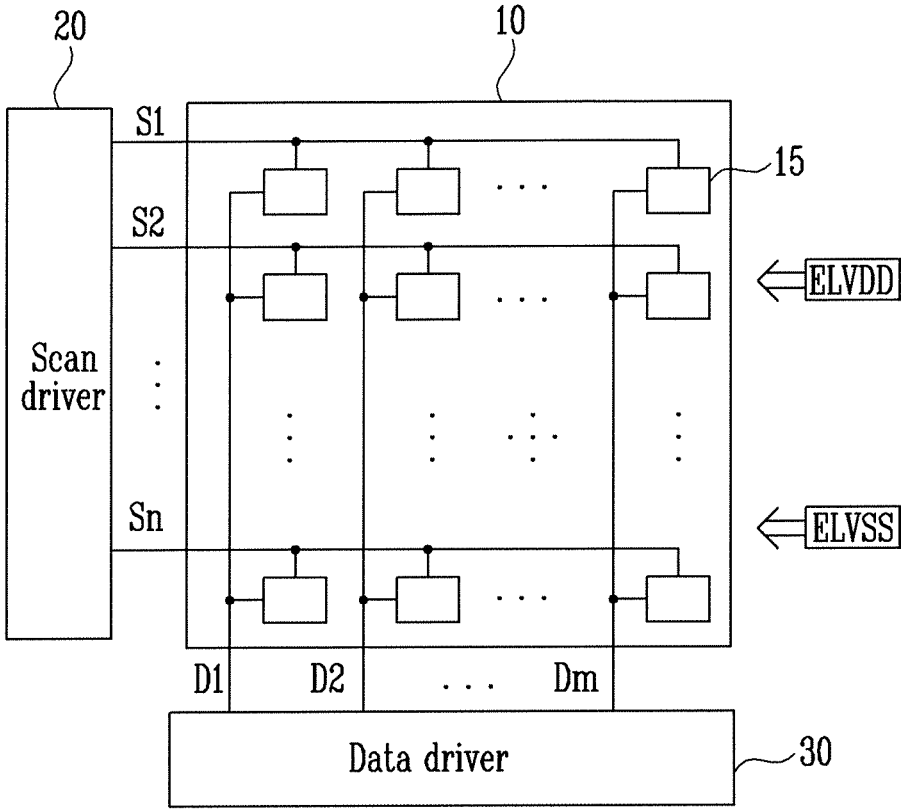
FIG. 1 is a block diagram illustrating a structure of an organic light emitting display according to an embodiment of the present invention.

Hereinafter, certain exemplary embodiments according to the present invention will be described with reference to the accompanying drawings. Here, when a first element is described as being coupled to a second element, the first element may be directly coupled to the second element, or may be indirectly coupled to the second element via one or more other elements. Further, some of the elements that are not essential to the complete understanding of the invention are omitted for clarity. Also, like reference numerals refer to like elements throughout.

The embodiments of the present invention will be described in detail with reference to the accompanying drawings.

FIG. 1 is a block diagram illustrating the structure of an organic light emitting display according to an embodiment of the present invention.

Referring to FIG. 1, the organic light emitting display according to the present embodiment includes a display unit 10, a scan driver 20, and a data driver 30.

The display unit 10 includes a plurality of pixels 15 arranged at crossing regions of scan lines S1 to Sn and data lines D1 to Dm arranged in a matrix, and is driven by receiving driving power sources, such as a high potential pixel power source ELVDD and a low potential pixel power source ELVSS from the outside (for example, an external power source supplying unit).

The pixels 15 that constitute the display unit 10 store data signals supplied from the data lines D1 to Dm coupled thereto when scan signals are supplied from the scan lines S1 to Sn coupled thereto, and emit light with the luminance components corresponding to the data signals. Therefore, an image corresponding to the data signals is displayed in the display unit 10.

The scan driver 20 sequentially generates the scan signals to correspond to externally supplied scan control signals (for example, supplied from a timing controller). The scan signals generated by the scan driver 20 are supplied to the pixels 15 through the scan lines S1 to Sn.

The data driver 30 generates the data signals to correspond to data and externally supplied data control signals (for example, supplied from the timing controller). The data signals generated by the data driver 30 are supplied to the pixels 15 in synchronization with the scan signals and through the data lines D1 to Dm.

The data driver 30 generates the data signals having voltages in accordance with gray levels of data based on a gamma voltage (e.g., a predetermined gamma voltage). When distribution is generated in a characteristic of a panel due to variation in manufacturing processes, images with different luminance components corresponding to the same data signal may be displayed on panels. Therefore, it is necessary to correct the measured luminance components of organic light emitting displays as completed products to be suitable for target luminance.

Therefore, according to embodiments of the present invention, there is provided a luminance correcting system capable of correcting variations in luminance generated by the distribution of the characteristics of the respective panels of the organic light emitting displays, so that panels may be produced with more uniform luminance.

Figure 2:
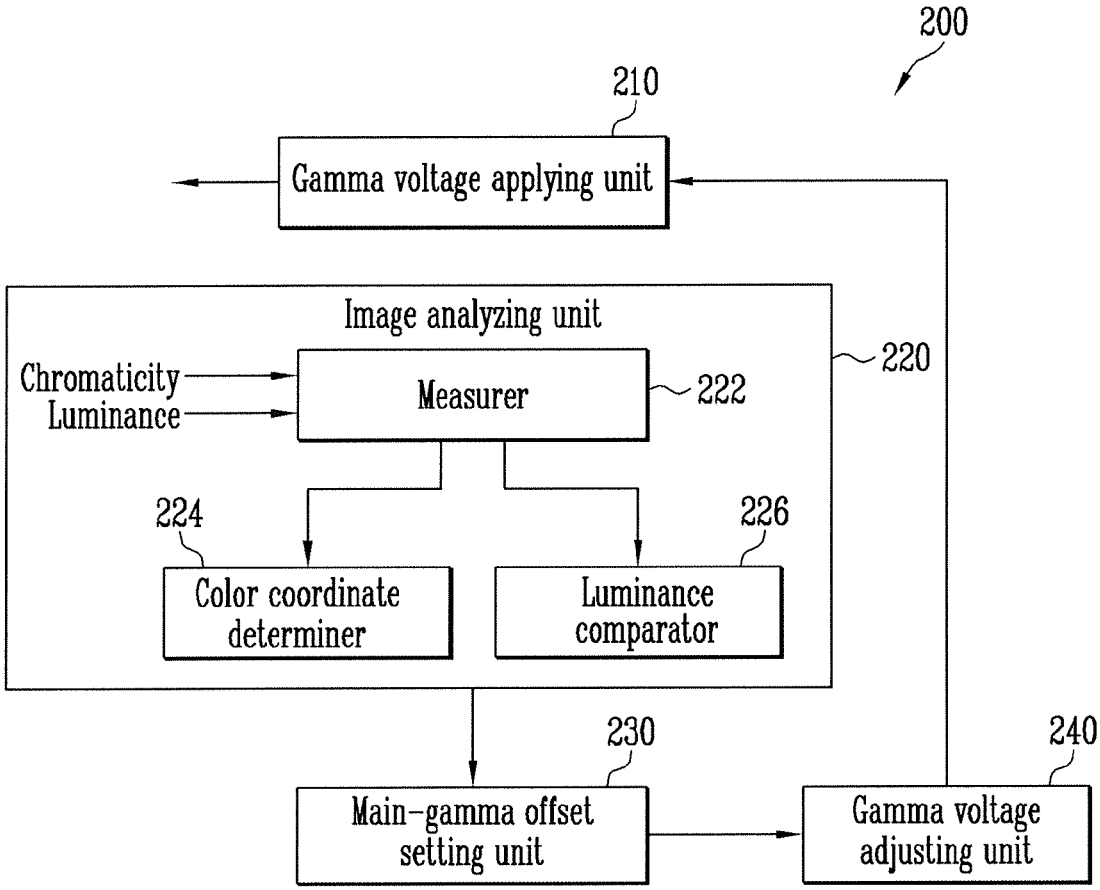
FIG. 2 is a block diagram illustrating a luminance correcting system according to the embodiment shown in FIG. 1.

FIG. 2 is a block diagram illustrating a luminance correcting system according to the present embodiment.

Referring to FIG. 2, the luminance correcting system 200 according to the present embodiment, which may be applied to the correction of the luminance and color coordinates of the organic light emitting display, includes a screen analyzing unit 220 (e.g., image analyzing unit 220), a reference offset value setting unit 230 (e.g., a main-gamma offset setting unit 230), a gamma voltage correcting unit 240 (e.g., a gamma voltage adjusting unit 240), and a gamma voltage applying unit 210.

The screen analyzing unit 220 analyzes the screen displayed on the display unit 10 of the organic light emitting display (e.g., analyzes an image displayed on the screen of the display unit 10 of the organic light emitting display) to measure luminance and color coordinates of a reference gray level.

According to the present embodiment, the data may correspond to, for example, 256 gray levels, that is, gray levels 0 to 255, with the reference gray level(s) being the gray level 255 and/or the gray level 127.

That is, together with the data of the highest gray level (e.g., gray level 255), data of another gray level at an inflection point on a luminance curve corresponding to the reference gray level, for example, the data of the gray level 127, may be further applied to a panel. In this case, since screen analysis (e.g., image analysis) with respect to a plurality of gray levels may be performed, precision of luminance correction may be improved.

In addition, the screen analyzing unit 220 may include a measuring unit 222 (e.g., measurer 222) for measuring chrominance and luminance of a screen, a color coordinate determining unit 224 (e.g., a color coordinate determiner 224) for determining color coordinates based on the measured chrominance, and a luminance comparing unit 226 (e.g., luminance comparator 226) for obtaining a difference between target luminance (e.g., predetermined target luminance) and the measured luminance.

The reference offset value setting unit 230 sets a reference offset value corresponding to the reference gray level data and the result of the screen analysis (e.g., image analysis) performed by the screen analyzing unit 220.

In detail, the reference offset value setting unit 230 may set a reference luminance offset value that has luminance controlled to correspond to a difference between the reference gray level obtained by the luminance comparing unit 226 and the target luminance, and may also set a reference color coordinate offset value that has chrominance controlled to correspond to the color coordinates with respect to the reference gray level obtained by the color coordinate determining unit 224.

For example, the reference offset value setting unit 230 sets a gamma control value, which corresponds to the difference between the target luminance and the measured luminance compensated for as the reference luminance offset value, and may set a color coordinate movement value, which may correct the color coordinates twisted by luminance correction or manufacturing tolerances, as the reference color coordinate offset value.

The reference offset value setting unit 230 may then determine the offset value corresponding to the luminance difference and/or the color coordinates through an equation or graph (e.g., a predetermined equation or graph).

The gamma voltage correcting unit 240 corrects the reference gamma voltage of the reference gray level to correspond to the reference offset value, which is set by the reference offset value setting unit 230, and supplies the corrected reference gamma voltage to the gamma voltage applying unit 210.

In particular, the gamma voltage correcting unit 240 may correct luminance by controlling the reference gamma voltage to correspond to the reference luminance offset value. For example, the reference gamma voltage is controlled by the sum of the reference gamma voltage and the reference luminance offset value to correct the luminance. The reference luminance offset value may be set as a negative value to reduce luminance that is measured to be larger than the target luminance, and may be set as a positive value to increase luminance when the measured luminance is smaller than the target luminance.

At this time, the reference gamma voltage is an ideal, or near ideal, gamma voltage corresponding to the previously described reference gray level, in which variation in the characteristics of the panels is not considered. As described above, when the reference offset value is applied to the reference gamma voltage, variation in the characteristics of the panels may be compensated for.

In addition, the gamma voltage correcting unit 240 may correct the chrominance by controlling the color coordinates using the reference color coordinate offset value.

The chrominance may be concurrently (e.g., simultaneously) corrected together with the luminance corresponding to the result of the screen analysis. However, the chrominance may be corrected by controlling the color coordinates after the luminance is corrected and the screen corresponding to the luminance correction result is analyzed. In this case, the twisted color coordinates may be corrected by correcting the luminance so that the variation in the characteristics of the panels may be effectively corrected.

The gamma voltage applying unit 210 applies the gamma voltage corrected by the gamma voltage correcting unit 240 (that is, the reference gamma voltage corrected in accordance with the reference gray level) to the data driver of the organic light emitting display. At this time, the corrected reference gamma voltage corresponds to the sum of the reference gamma voltage and the reference offset value, as described above.

According to the embodiment illustrated in FIG. 2, the luminance and the color coordinates of the reference gray level (e.g., the predetermined reference gray level) are corrected, and the offset value generated during the correction performed on the reference gray level is directly applied to the remaining gray levels. In this case, the correction close to the target value is performed on the reference gray level. However, the difference between the luminance and the color coordinates and the target value increases in the remaining gray levels, in particular, the gray levels that are further from the reference gray level.

In particular, due to variation in the manufacturing processes, the efficiency of the emission organic material of each of the red (R), green (G), and blue (B) colors may vary between different panels. Therefore, the reference offset values of the respective colors may be different from each other.

However, in the embodiment illustrated in FIG. 2, the correction is performed without reflecting the difference in the offset values of the respective colors, causing specific colors (e.g., reddish, greenish, and bluish hues) to be more pronounced in the gray levels that are further from the reference gray level (for example, the low gray levels).

In another embodiment of the present invention, the reference offset value is set to correct the gamma value of the reference gray level, the difference between the reference offset values of the respective colors is detected, and, when the detected difference is no less than the reference value, the additional offset value is set with respect to at least one gray level among the remaining gray levels excluding the reference gray level to apply the set offset value to the correction of the gamma voltage corresponding to the gray level, making it possible to prevent the color coordinates from being twisted in the respective gray levels and luminance components, and to prevent the specific colors (reddish, greenish, and bluish) from being as remarkable in the low gray levels.

Hereinafter, the detailed operation of the luminance correcting system according to the another embodiment of the present invention will be described with reference to FIGS. 3 and 4.

Figure 3:
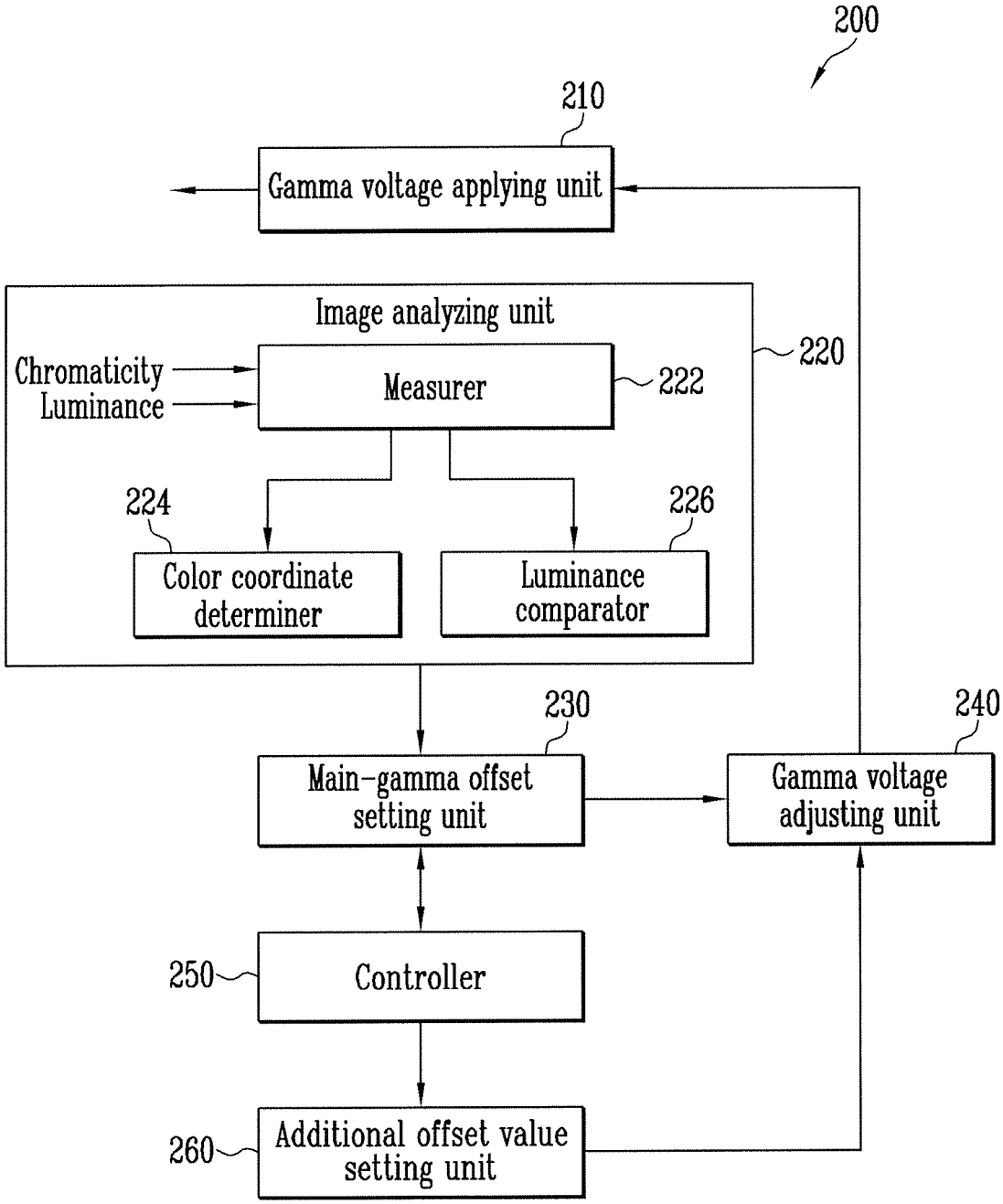
FIG. 3 is a block diagram illustrating a luminance correcting system according to another embodiment of the present invention.

FIG. 3 is a block diagram illustrating a luminance correcting system according to another embodiment of the present invention. In addition, FIG. 4 is a flowchart illustrating the luminance correcting method of the luminance correcting system of the embodiment illustrated in FIG. 3.

The same elements as those of the embodiment illustrated in FIG. 2 are denoted by the same reference numerals, and description thereof will be omitted.

Referring to FIG. 3, the luminance correcting system 200 according to the present embodiment includes a screen analyzing unit 220, a reference offset value setting unit 230 (e.g., a main-gamma offset setting unit 230), a gamma voltage correcting unit 240 (e.g., a gamma voltage adjusting unit 240), and a gamma voltage applying unit 210, as illustrated in FIG. 2, and further includes a controller 250 and an additional offset value setting unit 260.

That is, according to the embodiment illustrated in FIG. 3, the controller 250 detects a difference in the reference offset values set by the reference offset value setting unit 230 of the respective colors based on the reference gray level, and compares the difference with a reference value (e.g., a predetermined reference value).

Therefore, when the difference (e.g., a value of the difference) is not less than the reference value, an additional offset value is set by the additional offset value setting unit 260 corresponding to at least one gray level among the remaining gray level data excluding the reference gray level. At this time, the additional offset value is set based on the reference offset value.

For the sake of convenience, according to the present embodiment, a reddish phenomenon is reduced or prevented from being generated in the low gray levels. Therefore, the reference offset values of the respective colors compared by the controller are the reference offset values of the red (R) and blue (B) colors.

In addition, for example, the reference offset values are for data having a highest gray level (e.g., gray level 255), and the data of gray levels that may be additionally corrected are the data of gray level 85, gray level 43, and gray level 19, which correspond to low gray levels.

In the present embodiment, the data of the low gray levels may be gray level data having a value of no more than ⅓ of a value of the highest gray level data.

Figure 4:
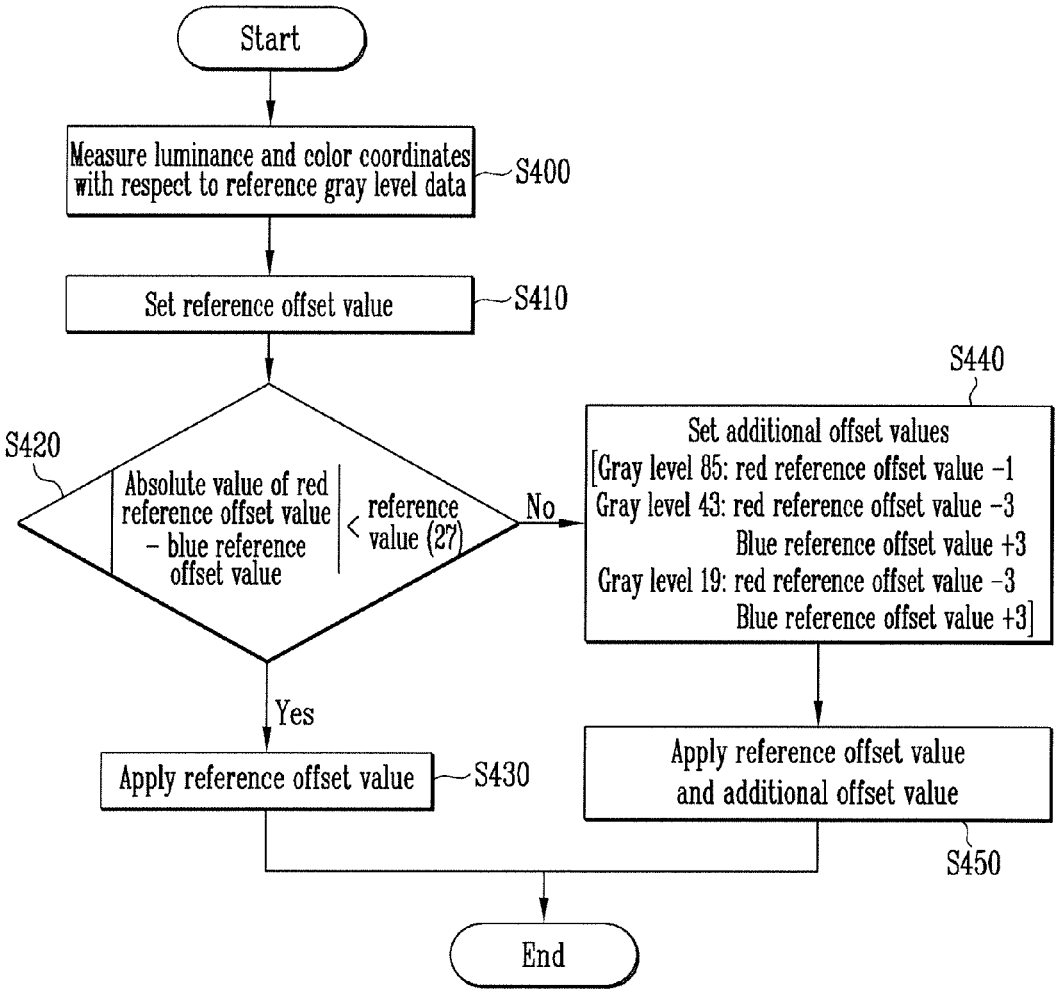
FIG. 4 is a flowchart illustrating the luminance correcting method of the luminance correcting system of the embodiment shown in FIG. 3.

First, as illustrated in FIG. 4, the screen displayed by the display unit 10 of the organic light emitting display is analyzed by the screen analyzing unit 220 to measure the luminance and color coordinates of reference gray level data (S400).

Then, the reference offset value of the reference gray level is set to correspond to the result of the screen analysis obtained by the screen analyzing unit 220 through the reference offset value setting unit 230 (S410).

At this time, when the data is realized by 256 gray levels, that is, the gray levels 0 to 255, the reference gray level may be the gray level 255 and/or the gray level 127. In the present embodiment, as described above, the reference offset value of the data of the highest gray level (the gray level 255) is set.

In the present embodiment, respective reference offset values are set corresponding to data of respective colors. That is, the reference offset values applied to the red, green, and blue data are set with respect to the gray level 255 through the above step.

In detail, the reference offset value setting unit 230 may set a reference luminance offset value, which has luminance controlled corresponding to a difference between the luminance and the target luminance of the reference gray level obtained by the luminance comparing unit 226 in the screen analyzing unit 220, and a reference color coordinate offset value may have chrominance controlled corresponding to the color coordinates of the reference gray level obtained by the color coordinate determining unit 224.

For example, the reference offset value setting unit 230 may set the gamma control value to correspond to a difference between the target luminance and the measured luminance compensated for as the reference luminance offset value, and may set a color coordinate movement value, which may correct color coordinates twisted due to luminance correction or due to problems during processes, as a reference color coordinate offset value.

At this time, the reference offset value setting unit 230 may determine the offset value corresponding to the luminance difference and/or the color coordinates through an equation or graph (e.g., a predetermined equation or graph).

As described above, when the offset value of the reference gray level is set with respect to each color, a difference in the reference offset values of the respective colors in the reference gray level is detected by the controller 250, and the difference is compared with a predetermined reference value (S420).

In the present embodiment, the difference in the reference offset values of the red (R) and blue (B) data is detected, as an example, although the present embodiment is not limited to the above.

In addition, in FIG. 4, the reference value is set as a specific number, 27 (e.g., reference value (27)), which may be corrected (e.g., selected) by a user. However, the present embodiment is not limited to the above number.

As described above, after the difference in the reference offset values of two different colors is compared with the reference value by the controller 250, when the difference is smaller than the reference value, as illustrated in FIG. 2, the reference offset value is applied to the remaining gray levels without setting an additional offset value (S430).

That is, the reference gamma voltage of the reference gray level is corrected to correspond to the reference offset value, and the corrected reference gamma voltage is supplied to the gamma voltage applying unit 210.

In addition, the gamma voltage applying unit 210 applies the gamma voltage corrected by the gamma voltage correcting unit 240, that is, the reference gamma voltage corrected based on the reference gray level is applied to the data driver of the organic light emitting display.

At this time, the corrected reference gamma voltage corresponds to the sum of the reference gamma voltage and the reference offset value as described above. Therefore, the data of all of the gray levels are corrected.

On the other hand, when a difference in the reference offset values of the two different colors is no less than the reference value, an additional offset value is set by the additional offset value setting unit 260 with respect to at least one gray level among the remaining gray levels excluding the reference gray level (S440). At this time, the additional offset value is set based on the reference offset value.

In detail, in FIG. 4, an additional offset value is set with respect to low gray level data, and the low gray level data is data of a value no more than, for example, that which corresponds to the gray level 85.

That is, the data of the low gray levels may be the gray level data of no more than ⅓ of the highest gray level data (e.g., gray level data having a value of no more than ⅓ of a value of the highest gray level data).

In the embodiment shown in FIG. 4, additional offset values are set with respect to the data of the gray level 85, the gray level 43, and the gray level 19.

In addition, in the present embodiment, as described above, it is possible to reduce or prevent the reddish phenomenon from being generated in the low gray levels. Therefore, the reference offset values of the respective colors compared by the controller 250 are the reference offset values of the red (R) and blue (B) colors.

That is, since the comparison result obtained by the controller 250 is no less than the reference value means that the reddish phenomenon may be generated in the low gray levels, the additional offset value is set and selected to prevent the reddish phenomenon from being generated.

For example, as illustrated in FIG. 4, the additional offset value with respect to the red reference offset value may be set as −1 for the gray level 85, the additional offset value with respect to the red reference offset value may be −3 for the gray level 43 and the gray level 19, and the additional offset value with respect to a blue reference offset value may be +3.

At this time, the additional offset values may be set with reference to the lookup table LUT stored in a storage unit (not shown), and the LUT may be realized by experimentally evaluating an optimal value that may prevent, or reduce, the phenomenon in which the specific colors (reddish, greenish, and bluish) are pronounced in the low gray levels, the additional offset values corresponding to the reference offset values applied to the red, green, and blue pixels after selecting a plurality of panels as exemplary models.

The additional offset values are applied to the gray levels excluding the reference gray level, in particular, the low gray levels using the LUT, making it possible to reduce or prevent the above-described phenomenon in which the specific colors (reddish, greenish, and bluish) are remarkable in the low gray levels.

Then, when the reference offset value and the additional offset values are set, the reference offset value and the additional offset values are applied to the respective gray levels (S450).

That is, the gamma voltages of the respective gray levels are corrected by the gamma voltage correcting unit 240 to correspond to the reference offset value and the additional offset values, and the corrected gamma voltages are supplied to the gamma voltage applying unit 210. The gamma voltage applying unit 210 applies the gamma voltages corrected by the gamma voltage correcting unit 240, that is, the gamma voltages corrected in accordance with the reference gray level and the specific low gray levels, to the data driver of the organic light emitting display.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A luminance correcting method for an organic light emitting display, comprising:

analyzing an image displayed on a display unit of the organic light emitting display and measuring luminance and color coordinates of reference gray level data;

setting reference offset values corresponding to respective color data in the reference gray level data corresponding to an image analysis result;

detecting a difference between a first reference offset value corresponding to a first color from among the reference offset values and a second reference offset value corresponding to a second color from among the reference offset values, the first color being different from the second color, and comparing the difference with a reference value, wherein the difference between the first and second reference offset values is a numerical value that is compared with the reference value; and setting an additional offset value corresponding to at least one gray level among remaining gray level data excluding the reference gray level data when the difference between the first reference offset value and the second reference offset value is not less than the reference value.

2. The luminance correcting method as claimed in claim 1, further comprising:

correcting a gamma voltage of the reference gray level data corresponding to one or more of the reference offset values and/or the additional offset value and outputting the corrected gamma voltage; and applying the corrected gamma voltage to a data driver of the organic light emitting display.

3. The luminance correcting method as claimed in claim 1, wherein the reference gray level data is data of a highest gray level.

4. The luminance correcting method as claimed in claim 1, wherein the remaining gray level data excluding the reference gray level data comprise low gray level data.

5. The luminance correcting method as claimed in claim 4, wherein the low gray level data has a value of no more than ⅓ of a value of a highest gray level data.

6. The luminance correcting method as claimed in claim 1, wherein the first color and the second color are among red, blue, and green.

7. The luminance correcting method as claimed in claim 1, wherein an additional offset value corresponding to color data having a largest reference offset value from among the first and second reference offset values has a negative value when the difference between the first and second reference offset values is not less than the reference value.

* * * * *